United States Patent [19]

Martinez

[11] 4,261,185

[45] Apr. 14, 1981

[54] RING WITH INTERNAL MEANS FOR VARYING SIZE

[76] Inventor: Luis M. Martinez, 23871 W. Le Bost Dr., Novi, Mich. 48050

[21] Appl. No.: 39,483

[22] Filed: May 16, 1979

Related U.S. Application Data

[63] Continuation-in-part of Ser. No. 916,011, Jun. 15, 1978.

[51] Int. Cl.[3] ..... A44C 9/02

[52] U.S. Cl. ..... 63/15.6; 308/244

[58] Field of Search ..... 63/15.6, 15.65, 19, 63/23

[56] References Cited

U.S. PATENT DOCUMENTS

| | | | |
|---|---|---|---|
| 152,789 | 7/1874 | Annin | 63/15.6 |
| 248,337 | 10/1881 | Missimer | 63/15.6 |
| 512,839 | 1/1894 | Oppenheimer | 63/15.6 |
| 1,115,764 | 11/1914 | Applas | 63/15.6 |
| 1,278,047 | 9/1918 | Smith | 63/15.6 |
| 1,558,418 | 10/1925 | Wendel | 63/15.65 |
| 1,741,908 | 12/1929 | Becker et al. | 63/15.6 |
| 2,966,048 | 12/1960 | Goossev | 63/15.6 |
| 3,460,356 | 8/1969 | Lodrini | 63/15.6 |
| 3,483,718 | 12/1969 | Lodrini | 63/15.6 |

FOREIGN PATENT DOCUMENTS

| | | | |
|---|---|---|---|
| 907191 | 6/1945 | France | 63/15.6 |
| 1191407 | 4/1959 | France | 63/15.6 |

*Primary Examiner*—F. Barry Shay

*Attorney, Agent, or Firm*—Jay C. Taylor

[57] ABSTRACT

An ornamental finger ring having in-built adjusting means enclosed within an interior slot in the shank and movable therein to constrict the opening and provide a plurality of selectable smaller finger openings to insure a snug fit and concurrently preserve the external appearance and contour of the ring. The adjusting means is a U-shaped finger-contacting member with resilient upper arms. Coacting means are on the ring and arms for adjustably latching the member in position. A tab at the member bight extends to the outside of the ring for manual manipulation, and the tab may have a slot dividing it at the part proximal to the bight to enhance its yieldability and make assembly into the ring less likely to permanently deform the member.

Wendel shows a ring with a shank including an adjustable U-shaped member.

2 Claims, 7 Drawing Figures

RING WITH INTERNAL MEANS FOR VARYING SIZE

BACKGROUND OF THE INVENTION

This invention is a continuation-in-part of my copending application Ser. No. 916011, filed June 15, 1978, and relates to an ornamental finger ring provided with means for adjusting the finger opening size to insure a snug fit during regular wear and to accommodate easy and comfortable passing of the band over the enlarged knuckle as the ring is placed on the finger of the wearer.

It has long been recognized that the knuckle of the ring finger is larger than the phalanx or shank of the finger bone, plus the muscle and skin thereon, closest to the palm. In persons afflicted with arthritis the size difference is sometimes so great that it is virtually impossible for the arthritic person to wear an ornamental finger ring comfortably. The problem is that an ornamental ring shank having a sufficiently large opening to pass over an arthritic knuckle is so loose on the finger when in normal wearer position adjacent the palm that it rotates on the finger to an undesirable position which interferes with ordinary use of the hand and too often fails to maintain the setting in an upright, exposed position.

The problem is one of long standing and many proposals for constricting the ring band after it has been slipped over the knuckle have been made. In the 1874 Patent to Annin, U.S. Pat. No. 152,789, a clip on filler secured by clips embracing the edges of the ring and pressed into indentations in the inner face of the ring was proposed and patented.

Other devices directed toward solving the same problem are disclosed in U.S. Pat. Nos. 3,218,826, 3,360,959 and 3,483,718; all of these devices constrict the opening in the band but provide externally visible, band-contour-changing add on means which detrimentally affect the ornamental appearance of the ring. Other references known to applicant which appear to be less pertinent include U.S. Pat. Nos. 2,281,231 and 3,204,426.

The primary object of this invention is to provide an ornamental ring having internal means for adjusting the size of the finger opening, after passing over the knuckle, to a selectable, comfortable snug fit without unsightly external projections or detrimental effect on the ornamental appearance of the ring either in the show case or on the hand of the wearer.

Other objects are to provide means for adjusting the size of the finger opening in an ornamental ring comprising a generally U-shaped resilient band which is substantially concealed within a radially inwardly opening slot in the shank of the ring and which is easily and positively adjustable by the wearer to constrict the opening or increase its size for removal of the ring over a knuckle; and to provide such a resilient band that can be fabricated to a desired pre-selected size separately from the ring and thereafter readily deformed within its elastic limits to enable its assembly within the slot of the ring without imparting an objectionable permanent set to the band.

DETAILED DESCRIPTION OF THE INVENTION

Figure 1:
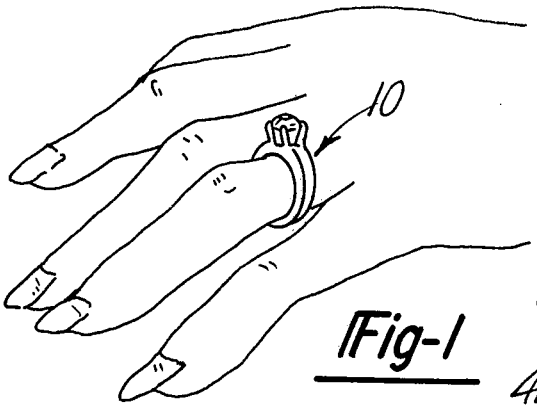
FIG. 1 illustrates the improved adjustable ring of this invention on the hand of a wearer.

The ornamental adjustable ring of this invention generally designated 10, comprises a shank 12 having a setting 14 supported in conventional tines 16 and an adjustment band of U-shape generally designated 18. Band 18 is provided with a tab 20 located centrally in the bight portion of the band and each arm 22, 24 terminates at its upper end portion in a lock means, or ratchet member, 26, 28 respectively.

Shank 12 is provided with a relatively narrow slot 30 located centrally of the width of shank 12. Slot 30 opens through the interior surface 31 and is spaced inwardly from the external surface 33 of shank 12, as shown. Slot 30 extends from end surface 32 which is adjacent to and spaced from the right hand side of setting 14 around the bight portion of shank 12 to end surface 34. The ends 32, 34 of slot 30 are located above a horizontal plane extending through the diameter of shank 12 a suitable distance sufficient to accommodate the number of serrations 36, 38 which are located in the upper end portions of wall surface 40, 42 respectively.

Wall surfaces 40, 42 preferably form a right angle with end surfaces 32, 34 respectively to thereby provide opposing pairs of serrations 36, 38 at the same level to receive the beveled end surface 44 of ratchet members 26 and 28. Vertical wall surfaces 40, 42 and serrations 36, 38 thereon thus provide positive locking at the level of each pair of opposed serrations. Additionally, as ratchet members 26, 28 move upwardly to a new locking position the inner arm 46 adjacent the upper end lies within the arc of curvature of slot 30 and does not protrude inwardly to contact the wearer's finger or produce an unslightly appearance. The distance of end surfaces 32, 34 above the uppermost serration 36, 38 is approximately equal to the vertical height of locking arm 48 so that members 26, 28 nest in space 49 defined by inner shank surface 31, end walls 32, 34 and serration containing walls 40, 42.

Figure 7:
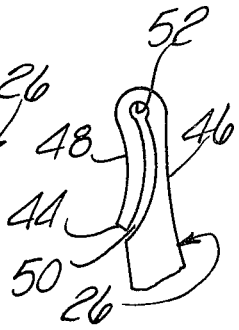
FIG. 7 is an enlargement showing the detail of the preferred locking tab on the upper end of the adjustment band.

It is to be understood that the length of spring ratchet member arm 48 shown in FIG. 7 is illustrative only and may be shortened or lengthened, as needed, to provide more or less serrations and free vertical space above the uppermost serration and surfaces 32 and 34.

Figure 2:
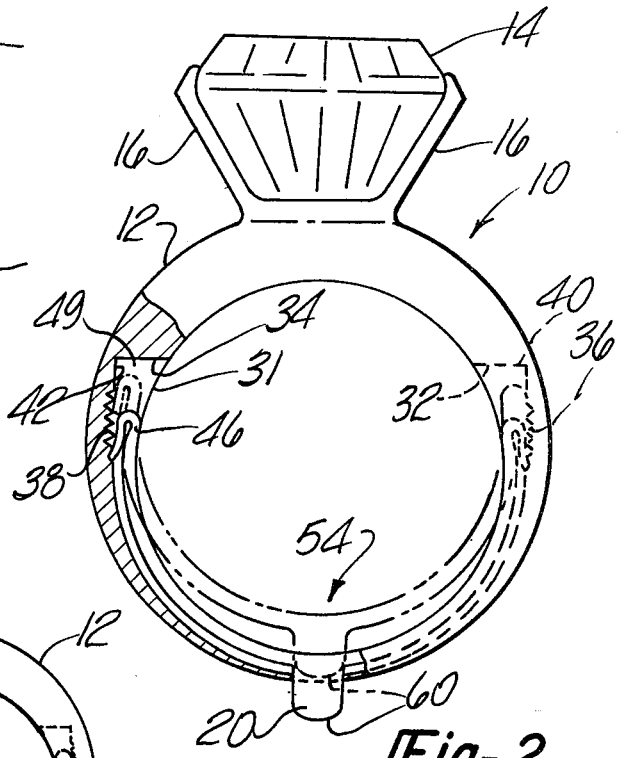
FIG. 2 is a view, partly in section, showing an ornamental ring having the adjustable band therein and illustrating the showcase position of the adjustable band in solid lines and the location of the band position when on the finger of a wearer in dotted lines.

Arm 48 is separated from inner arm 46 by slot 50 which terminates at its inner end in aperture 52. The curvature of arm 48, width of slot 50 and size of aperture 52 are selected so as to provide the needed spring, or elasticity, characteristics to cause the end surfaces 44 of arms 48 to seat snugly against a pair of serrations 36, 38 and remain in place during normal wearing of the ring. On the other hand, the degree of elasticity, or strength, of arm 48 is such as to allow relatively easy disengagement from a pair of opposed serrations when downward force is applied to the bight portion of adjustable band 18 at the arrow 54 to thereby cause tapered surface 44 to spring inwardly to permit slidable disengagement from the serrations, as best seen in FIG. 2. Any material possessing the desired strength and elasticity characteristics may be used such as alloys of white or yellow gold or silver, stainless steel, or the like. Particularly good results are obtained with hard dental gold alloys.

Figure 4:
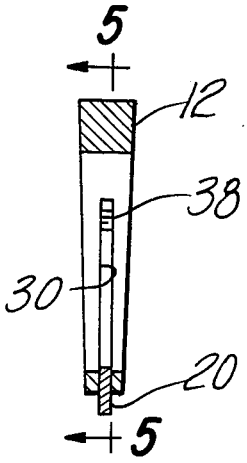
FIG. 4 is a view taken along the line 4—4 of FIG. 3.
Figure 3:
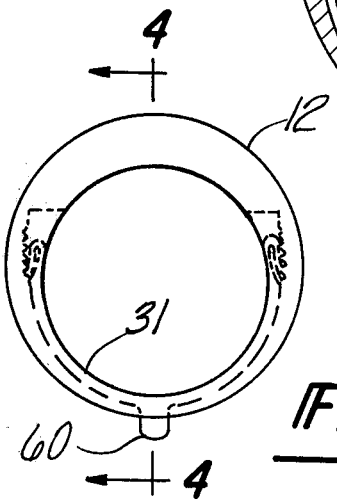
FIG. 3 illustrates a shank which includes the internal adjustable band feature of this invention and which is adaptable to form an ornamental ring by the addition of a selected setting.
Figure 5:
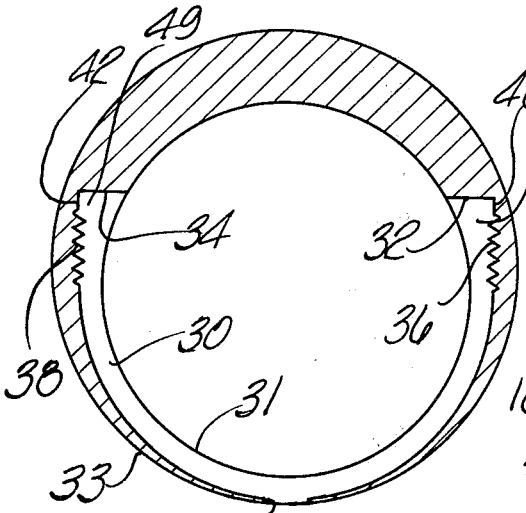
FIGS. 5 and 6 are enlarged views of the shank and a modified adjustment band respectively prior to being assembled together, taken essentially along the line 5—5 of FIG. 4.

Inwardly open slot 30 is provided, at a location opposite from setting 14, with slot 56 which extends through the exterior surface 33 of shank 12. Slot 56 is located centrally of the width of the shank at its bight portion as may be seen in FIG. 4. Slot 56 is adapted to receive tab 20 with a sliding fit such that tab 30 fills the slot when the adjustable band 18 is in its normal inserted position for normal snug fit on the finger of the wearer as shown in dotted lines in FIG. 2. The length of tab 20, as indicated at 58 in FIG. 5, is substantially similar to the vertical length of serrations 36, 38 as the ring, or shank, is made and provided to jewelers for showcase display. The length 58 of tab 20 may remain the full length to provide the maximum amount of constriction of the opening in shank 12 for those customers having substantial knuckle enlargement and a small phalanx. Alternately tab 20 may be shortened by the jeweler to fit fingers requiring less constriction to a length such that the outer end surface of tab 20 lies in the surface or arc of curvature of shank 12 when the adjustable band 18 is in its normal wearer position. In either instance, the external surface 60 of tab 20 is preferably rounded to the curvature of shank 12 such that it does not protrude when in normal wearer position.

Adjustable bands 18 and shanks 12 are separately fabricated in a plurality of sizes of finger opening and lengths 58 for tab 20. The adjustable ring or shank of this invention is formed when band 18 is assembled into slot 30 in shank 12 by positioning tab 20 into the inner end of slot 56 and slightly compressing arms 22 and 24 toward each other to enable snapping them into place such that ratchet members 26, 28 engage serrations 36, 38. During the assembly, each ratchet arm 48 will also yield slightly to close or partially close its associated slot 50. Accordingly the resilient deformation of band 18 required for its assembly within slot 30 will be assumed in part by the arms 48 and in part by the arms 22, 24, thereby to increase the total amount of resilient distortion to which the band 18 can be subjected without exceeding the elastic limits of the deformed parts or imparting a permanent set thereto that would impair the resiliently yieldable interlocking engagement between the ratchet members 26, 28 and serrations 36, 38.

A preferred embodiment of the ring or shank shown in FIGS. 2 and 5 respectively, has four or five serrations providing a vertical travel of surface 44 on ratchet members 26, 28 of 3.7–3.8 millimeters. This length of adjustment has been found to be adequate to accommodate extreme knuckle enlargements and provide a snug fit during normal wear. The constriction of the ring opening resulting from vertical movement of the bight portion of band 18 as ratchet members 26, 28 move from the lower to the uppermost pair of serrations is somewhat less than the vertical bottom to top length of the serrations. Experience has shown that constriction equal to three or four ring sizes, as measured by United States standard ring size mandrels, is sufficient and diameter constrictions from No. 9 ring size to No. 5 ring size is 3.2 millimeters whereas constriction from No. 9 ring size to No. 6 ring size is 2.35 millimeters. Tab length 58 of 3.75±0.05 millimeters provides adequate tab length to allow the jeweler to fit the ring or shank of this invention to individual customer needs.

Placing the ring of this invention on the finger of a wearer is easily accomplished by the wearer by first applying force at arrow 54 to position band 18 entirely within slot 30 with maximum extension of tab 20 outside the arc of curvature of shank 12 as shown in solid lines in FIG. 2. Such adjustment to the maximum ring size is facilitated by the cam action between surfaces 44 and the engaged serrations 36, 38. As force is applied to the band 18 at 54 in the direction of the arrow, the resilient band 18 tends to elongate vertically. The locking arms 26, 28 simultaneously move inwardly toward each other and out of the indentations of the serrations 36, 38 until the band 18 seats firmly against the shank 12 at the solid line position, FIG. 2. The wearer then inserts the ring finger by passing the ring over the knuckle and into place adjacent the palm. The wearer then presses the exterior surface 60 of tab 20 against any flat surface to force tab 20 inwardly until the exterior surface 60 lies in the arc of curvature of shank 12, as shown in dotted lines in FIG. 2. The inward motion causes ratchet members 26, 28 to move upwardly and successively pass by cam action over serrations 36, 38 to reach the locked in place position shown in the upper dotted line position in FIG. 2.

The adjustment band 18 illustrated in FIG. 2 is suitable for use with resilient materials having adequate resistance to fatigue and flexibility within its elastic limits, so that during the initial assembly of the band 18 and shank 12, the arms 22, 24 may be bent toward each other sufficiently to enable their placement within the slot 30 without exceeding their elastic limit or imparting an objectionable permanent set thereto that would impair the resilient interlocking engagement between the ratchet members 26, 28 and the serrations 36, 38.

Figure 6:
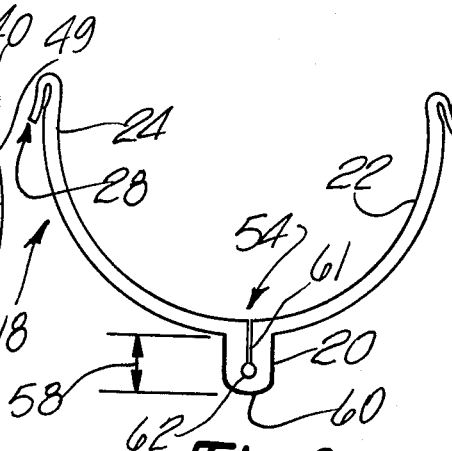

The range of resilient materials suitable for the band 18 may be appreciably increased and recourse to unusual and expensive alloys avoided by providing a small radially upwardly or inwardly opening slot 61 in the tab 60, FIG. 6. Thus, when the arms 22, 24 are bent toward each other during their initial assembly into the slot 30, the necessary resilient deformation will be distributed between portions of the tab 60, by reason of the slot 61, and the arms 22, 24, 48. The assembly may then be completed with only nominal distortion of any one portion of the band 18, thereby minimizing the likelihood of exceeding the elastic limit of any portion of the band 18 and causing a permanent set thereto that would reduce the effectiveness of the resiliently urged ratchet-type interlocking engagement between the members 26, 28 and the serrations 36, 38. In all other respects the band 18 shown in FIG. 6 functions in the manner described above in regard to FIG. 2.

The base of the slot 61 enlarges at a circular aperture 62 to reduce localized stress concentration thereat. The aperture 52 serves a similar function at the base of slot 50.

It will be appreciated that the above described embodiments provide an easily adjustable ring, or shank, to accommodate arthritic, or enlarged, knuckles in a construction free of unsightly external projections such that the overall appearance on the hand of the wearer is that of a non-adjustable ring.

What is claimed is:

1. The combination in a finger ring comprising a generally circular shank having a setting on its exterior surface and also having an inwardly opening shank slot in its inner wall, said shank slot extending around the bight portion of said shank and terminating at opposite sides of said setting, said shank having an externally opening tab slot therein communicating with said shank slot opposite said setting, a U-shaped band adapted to fit adjustably within said shank to adjust the size of the finger opening therein, said band having upwardly extending U-arms resiliently yieldable toward each other to enable insertion of the band within the shank, the band also having a depending tab adjacent its bight, and means to facilitate said insertion of the band within the shank (and) without necessitating the yielding of said U-arms toward each other sufficiently to effect an objectionable permanent set to the band comprising an upwardly opening slot in said tab partitioning the upper portions thereof into two parts resiliently yieldable toward each other similarly to the yielding of said U-arms toward each other, said band being adapted to fit in said shank slot for movement therein toward and from said tab slot, said tab being adapted for movement through said tab slot, and means on said U-arms and shank for latching said band in an adjusted position constricting the size of the finger opening in said shank.

2. The combination according to claim 1, said means for latching comprising latching means in said shank slot at opposite sides of said setting and also comprising latching means associated with each of said U-arms for resiliently engaging and releasably latching with the latching means in said shank slot, the latching means associated with each U-arm comprising a detent engaging portion spaced outwardly from the associated U-arm, means resiliently connecting an upper end of each detent engaging portion with its associated U-arm, each detent engaging portion extending downwardly and outwardly from its upper end to a lower end resiliently yieldable toward and from its associated U-arm.

* * * * *

UNITED STATES PATENT AND TRADEMARK OFFICE

CERTIFICATE OF CORRECTION

PATENT NO. : 4,261,185

DATED : April 14, 1981

INVENTOR(S) : Luis M. Martinez

It is certified that error appears in the above—identified patent and that said Letters Patent is hereby corrected as shown below:

Column 3, line 18 "tab 30" should be -- tab 20 --.

Signed and Sealed this

*Thirteenth* Day of *October 1981*

[SEAL]

*Attest:*

GERALD J. MOSSINGHOFF

*Attesting Officer*

*Commissioner of Patents and Trademarks*